United States Patent [19]

Bergmann et al.

[11] Patent Number: 4,491,823

[45] Date of Patent: Jan. 1, 1985

[54] ROTARY RESISTORS

[75] Inventors: Michael J. Bergmann, Nuremberg; Armin Lederer, Cadolzburg; Norbert Walliser, Furth, all of Fed. Rep. of Germany

[73] Assignee: Siegert GmbH Company, Fed. Rep. of Germany

[21] Appl. No.: 438,517

[22] Filed: Nov. 1, 1982

[30] Foreign Application Priority Data

Oct. 31, 1981 [DE] Fed. Rep. of Germany ... 8131856[U]

[51] Int. Cl.[3] ..... H01C 10/34

[52] U.S. Cl. ..... 338/174; 338/162

[58] Field of Search ..... 338/162, 163, 174, 164, 338/188, 199, 184, 325, 333

[56] References Cited

U.S. PATENT DOCUMENTS 2,443,018 6/1948 Arvin et al. ..... 338/174

FOREIGN PATENT DOCUMENTS 1036986 8/1958 Fed. Rep. of Germany ..... 338/162
1399542 7/1975 United Kingdom ..... 338/174
2028594 3/1980 United Kingdom ..... 338/174

*Primary Examiner*—C. L. Albritton
*Attorney, Agent, or Firm*—Bacon & Thomas

[57] ABSTRACT

A rotary resistor or rheostat used in hearing aids worn behind the ear. Such an application necessitates a small, compact arrangement. The arrangement is provided with a supporting surface acting as a substrate with the prerequisite conductors or resistances applied to the support surface.

3 Claims, 2 Drawing Figures

ROTARY RESISTORS

BACKGROUND OF IHE INVENTION

This invention concerns a rotary resistor or rheostat. It particularly relates to very small rotary resistors the preferred field of application of which is in hearing aids worn behind the ear. These hearing aids are carried behind the ear and in view of the space available, must be very small. The invention concerns in particular rotary resistors consisting of a substrate with layers of precious metals, nonprecious metals, metal oxides or other materials forming conductors or resistances applied to it.

The electric connection between the wiper potential and the rear solder contact surface consists in these rotary resistors of a pin or rivet forming the rotating axle of the wiper. Both of these embodiments have the disadvantage that especially in very small configurations the manufacture and the mounting of the rivet or the pin is extraordinarily difficult and thus expensive. Furthermore, the transfer resistances between the rivet or the pin and the rear solder contact surface and the wiper are relatively high.

It is known according to German Publication No. DE-GM 72 76 541, in a variable resistor with a support base and a resistance and wiper path, asymmetrically to said path a plurality of boreholes is provided, connected at their ends by conductors, which, however, as the result of their position serve an entirely different purpose, i.e., the additional fastening of the conductors and possibly the creation of further potential connections. In the case of the invention, on the other hand, the metal coating serves to conduct the wiper potential to the rear solder contact surface without difficulty and with the least possible transfer resistance.

SUMMARY OF THE INVENTION

It is the object of the invention to render this electric connection in a rotary resistor.

The object of the invention is attained by providing a rotary risistor with a support plate. On a frontal side of the support plate is located a resistance layer, solder contact surfaces and a wiper in sliding contact with the resistance layer. The rear side of the support plate has a rear solder contact surface connected through a bore of the support plate with the resistance layer by means of an electrical conductor. The resistance layer, the wiper potential and the solder contact surfaces are printed on the support plate. Thereby, in rotary resistors and in particular in rotary resistors in the aforementioned forms of embodiment of the invention, an improved electrical conduction to the rear solder contact surface on the one hand, and to the wiper, on the other hand, is obtained, as the transfer resistances are correspondingly reduced in these contact points. In particular, the use of metallic coatings of this type is much less costly than the use of rivets or rotating shafts in the known resistors.

The disclosure sets forth a preferred form of embodiment of the invention, effecting an improvement of the contact of the wiper with the metal coating.

The disclosure also represents a preferred form of embodiment of the invention, effecting a further reduction of the electric resistance between the wiper and the rear solder contact surface. In addition, a separate mechanical fastening between the metal coating on the one hand and the rear solder contact surface and the annular surface, on the other hand, is eliminated.

BRIEF DESCRIPTION OF THE DRAWINGS

Further advantages and characteristics of the invention will become apparent from the description hereinafter and the drawing attached thereto of a form of embodiment of the invention. In the drawing.

DESCRIPTION OF A PREFERRED EMBODIMENT

Figure 2:
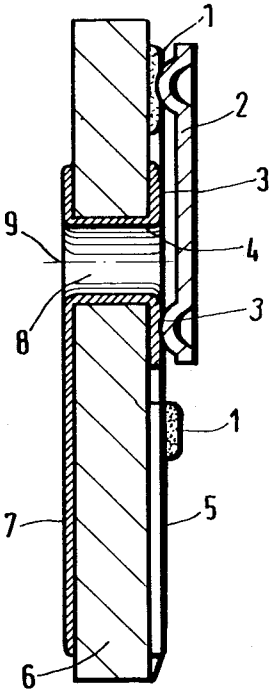
FIG. 2 is a cross section according to the line II—II in FIG. 1.
Figure 1:
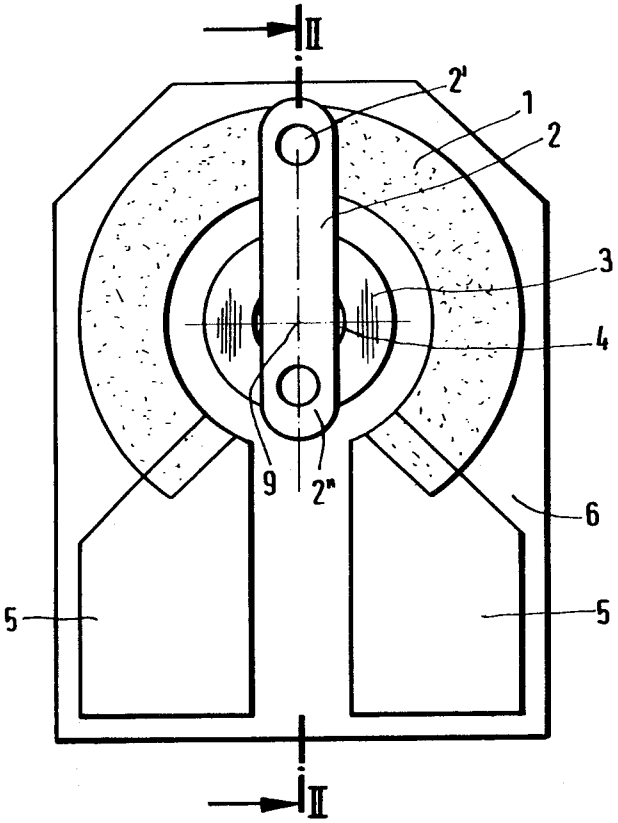
FIG. 1 shows a top view of a rotary resistor according to the invention.

The rotary resistor has a support plate 6, the front side whereof is provided with a circular resistance layer 1 and with solder contact surfaces 5 electrically connected with said resistance layer. A wiper 2 has a first end 2' in contact with the resistance layer and a second end 2'' in contact with the annular surface 3 surrounding the bore 8 on the frontal side of the support plate, which also consists of a conducting material. The rotating axle of the wiper 2, not shown in detail, is designated by 9. The bore 8 is concentric with the resistance layer 1 and the annular surface 3.

The rear side of the support plate, located to the left in FIG. 2, carries a rear solder contact surface 7. The base of the rotating resistor, shown at the bottom in the drawing, may be set into a printed circuit or the like, while the solder contact surfaces 5, which are connected electrically with both ends of the resistance layer 1, on the one hand, and the rear solder contact surface 7, which is electrically connected with the wiper take-off or potential, on the other hand, are soldered to corresponding counter contacts provided with the printed circuit.

The electrical connection of the rear solder contact surface 7 with the wiper 2 is effected by a metal coating 4, which is located on the inner wall of the bore 8 and is solidly and electrically connected at the front side of the support plate with the annular surface 3 and at the rear side with the rear solder contact 7. Preferably, the solder contact surface 7, the coating 4 and the annular surface 3 may consist of a layer of the same conducting material, with the layer being homogeneous in itself.

The support plate 6 may consist of a single substrate or a multiple substrate.

We claim:

1. A rotary resistor comprising a one-piece substrate with frontal and rear surfaces and a one-piece metallic wiper which is arranged for rotational adjustment around a fixed point on the substrate and in contact with its frontal surface such that said wiper electrically bridges two mutually insulated printed sections wherein one section consists of a highly conductive thin-film coating of pure metal homogeneously deposited on the frontal surface of the substrate in an annular pattern, on a portion of the rear surface of the substrate so as to form an integral solder contact, and fully through an aperture centered on said fixed point on the substrate, and wherein the other printed section consists of a thin-film coating of relatively less conductive material homogeneously deposited on said frontal surface and arranged thereon in an annular pattern concentric with and outside of the conductive printed section on the frontal surface of the substrate and further arranged for ohmic contact with two additional mutually insulated printed sections of homogeneously deposited pure metal thin films so that these latter two printed sections may function as two individual solder contacts, connectable to the leads of an external circuit whereby a resistor is formed, or further connectable, through the metallic wiper to the inner annular printed metal section and thereby to said integral solder contact on the rear surface of the substrate to a second or third external circuit lead to form a rheostat or potentiometer respectively.

2. The rotary resistor according to claim 1 whereby every thin-film printed section is homogeneous as to composition and uniform as to layer height or depth of deposition.

3. A rotary resistor according to claim 1 or 2 whereby the junctions formed on the frontal surface of the substrate between the annular less conductive printed section and the two printed metallic solder contacts are of an overlapping nature such that, with the metallic coatings on the bottom and the less conductive coating on the top, the height of said junctions is greater than for any other homogeneous printed section on the frontal surface of the substrate but not less than thickness of the less conductive printed material.

* * * * *